US005527495A

United States Patent [19]

Jones

[11] Patent Number: 5,527,495

[45] Date of Patent: Jun. 18, 1996

[54] CHARGE FORMING FUEL SYSTEM

[76] Inventor: James M. Jones, 413 W. Jefferson, Waxahachie, Tex. 75165

[21] Appl. No.: 381,113

[22] Filed: Jan. 31, 1995

[51] Int. Cl.[6] ..... F02M 7/16

[52] U.S. Cl. ..... 261/39.2; 261/69.2

[58] Field of Search ..... 261/39.2, 69.2

[56] References Cited

U.S. PATENT DOCUMENTS

| | | | |
|---|---|---|---|
| 2,316,327 | 4/1941 | Garretson | 261/69 |
| 2,343,451 | 3/1944 | Garretson | 261/69.2 |
| 2,372,306 | 3/1945 | Adair | 261/69 |
| 3,009,794 | 11/1961 | Barfod | 48/184 |
| 3,174,730 | 3/1965 | Barr | 261/69.2 |
| 3,409,276 | 11/1968 | Fuchs | 261/69.2 |
| 4,632,788 | 12/1986 | Jones | 261/41.5 |
| 4,965,023 | 10/1990 | Jones | 261/69.2 |

*Primary Examiner*—Tim R. Miles
*Attorney, Agent, or Firm*—Jenkens & Gilchrist

[57] ABSTRACT

A fuel sensing diaphragm and an air sensing diaphragm apply opposing forces to a transfer member. The forces applied by the fuel sensing diaphragm are based upon the flow rate of fuel, and the forces applied by the air sensing diaphragm are based upon the air flow rate through a venturi. The fuel sensing diaphragm, transfer member, and air sensing diaphragm move together as a control unit which controls the amount of free air allowed to enter an air chamber. Free air in the air chamber is bled off across a vacuum orifice connected to a vacuum port below the throttle plate. The air chamber is in fluid communication with a regulator air chamber. The regulator air chamber is separated from a regulator fuel chamber by a regulator diaphragm and plunger. The regulator diaphragm and plunger operates a fuel inlet ball valve which controls the flow of fuel. A regulator diaphragm and plunger operates the fuel inlet valve based on the pressure in the regulator fuel chamber, the pressure in the regulator air chamber, and the force of a regulator spring. Fuel is discharged through a fuel discharge into an accelerated air stream caused by an air orifice. The mixture of accelerated air and discharged fuel enter the main air stream below a throttle plate. Changes in air density are compensated for by an aneroid chamber regulating the pressure differences on the air sensing diaphragm, which alters the forces the air sensing diaphragm applies to the transfer member.

17 Claims, 4 Drawing Sheets

CHARGE FORMING FUEL SYSTEM

BACKGROUND

1. Field of the Invention

The present invention relates to liquid fuel feed systems, and more particularly to charge forming devices which compare the flow rate of the air and the fuel in order to control the fuel delivered by the system 2. History of the Prior Art The conventional gasoline carburetor has a fuel chamber which is vented to the outside air. A fuel inlet needle valve is controlled by an adjustable float to provide the proper liquid level of fuel within the fuel chamber. The movement of air through a venturi bore provides the pressure difference necessary to move the fuel into the air stream.

The conventional charge forming device senses a quantity of air movement through the venturi by means of an air sensing diaphragm, and balances the force on the air sensing diaphragm against that of an opposing force by a fuel-sensing diaphragm, which senses the quantity of fuel movement across a fuel orifice. The two diaphragms are connected by a member which controls a fuel discharge valve. An increase or decrease in air movement unbalances the diaphragms and causes a repositioning movement of the diaphragms to a balanced position. An increase in air movement causes a diaphragm movement which further opens a fuel discharge valve, and a decrease in air movement causes a diaphragm movement which restricts the fuel discharge valve. However, in order to assure a proper liquid head of fuel to the fuel discharge valve, prior art charge forming devices must rely upon a constant fuel inlet pressure such as provided by a rotary vane type of fuel pump.

Also, conventional carburetors and charge forming devices require a sufficient movement of air through the venturi bore before fuel will flow to the engine. At cranking speeds, it has been necessary to utilize choke plates to increase the pressure difference across the venturi in order to allow fuel to flow, or to provide manual primers to pump fuel into the inlet bore which allows the engine to start. This has been especially true for small one or two cylinder air-cooled engines which have relatively slower cranking speeds. As a result, certain small engines have been eliminated from being utilized in applications requiring remote or automatic starting, such as backup generators or pumps.

Another problem with the conventional carburetors and charge forming devices is the drift in the air density which alters the air-fuel ratio, which is a mass relationship rather than a volumetric relationship. When a carburetion system is sized for a particular cubic inch displacement engine, the cross-sectional area of the venturi bore is sized for a flow rate which is based upon the air density at a given altitude and temperature. An increase in altitude and/or temperature results in a lighter air density which causes the base air-fuel mixture to drift to a rich ratio. Such ratios result in higher proportions of unburned pollutants released to the atmosphere and in a reduced fuel economy. A decrease in altitude and/or temperature results in a lean ratio which results in higher emissions, a loss of engine power due to a slower combustion, and also a reduced fuel economy. For example, a base ratio of 12.8 to 1 at sea level and 60° F., will drift to lean mixture of 14.76 to 1 at 1000 feet below sea level and −40° F., and will drift to a rich mixture of 9.5 to 1 at 12,000 feet above sea level and 140° F. The drift at sea level within a temperature range of −40° F. to 140° F. is from a ratio of 14.23 to 1, to a ratio of 11.91 to 1.

It would be an advantage to have a charge-forming device which could internally control the liquid head of the fuel to the discharge valve; which could provide for remote and automatic starting capability; and which could provide a stabilized air-fuel ratio for various ranges of air densities.

SUMMARY OF THE INVENTION

The present invention utilizes a fuel shut-off valve to prevent fuel flow when the charge forming fuel system is not in operation. The fuel shut-off valve is an on-off type valve and is opened by a very light vacuum across a fuel shut-off diaphragm, thereby allowing for an easy start.

Upon cranking, the fuel shut-off valve opens and fuel is discharged past the shut-off valve and through a fuel discharge. Fuel exiting the fuel discharge mixes with an accelerated air stream. The mixture of discharged fuel and accelerated air enters the main air stream of the venturi below the throttle plate.

An air sensing diaphragm senses the flow rate of air through the venturi, and applies a force to a transfer member based on the flow rate of air through the venturi. The greater the air flow rate through the venturi, the greater the force applied to the transfer member by the air sensing diaphragm. An opposing force is applied to the transfer member by a fuel sensing diaphragm. The force applied to the transfer member by the fuel sensing diaphragm is based on the flow rate of fuel through the charge forming fuel system. The greater the fuel flow rate, the greater the force applied to the transfer member by the fuel sensing device.

Once the engine starts, the air sensing diaphragm, the transfer member, and the fuel sensing diaphragm move together as a single control unit. The forces acting upon the two diaphragms seek to balance one another. Changes in the air or the fuel movement result in a repositioning of the diaphragms. These repositioning movements throttle a free air orifice which feeds ambient air to an air chamber below a fuel regulator diaphragm and plunger assembly. The free air in the air chamber is bled back to a manifold vacuum source across a vacuum orifice.

A fuel regulator diaphragm and plunger assembly controls a fuel inlet ball valve that is normally open due to the force of the regulator spring. The fuel moves into a fuel regulator chamber and crosses into the primary fuel chamber. Fuel in the primary fuel chamber passes through a fuel orifice located at the center of the fuel sensing diaphragm before crossing through the cross-holes of the transfer member into a secondary fuel chamber. Fuel from the secondary fuel chamber passes to the fuel shut-off valve for subsequent discharge through the fuel discharge during operation of the engine.

The purpose of the liquid head control is to provide the proper amount of fuel to the fuel discharge to meet the changing air-fuel demands of the engine. It does not require a constant fuel inlet pressure. An increased demand for fuel causes a movement of the control unit (air-sensing diaphragm, transfer member, and fuel-sensing diaphragm) away from the free air orifice which results in an increased pressure difference across the fuel orifice to feed the discharge. Movement of the control unit away from the free air orifice increases the volume of air acting upon the fuel regulator diaphragm and plunger assembly which further opens the fuel inlet ball valve to allow more fuel to enter the system to feed the increased demand. Inversely, a decreased demand for fuel causes the control unit to move towards the free air valve. Movement of the control unit towards the free air orifice reduces the volume of air acting upon the fuel regulator diaphragm and plunger assembly which further closes the fuel inlet ball valve to restrict the flow of fuel into the system to meet the decreased demand. In this manner the liquid head control provides the proper flow of fuel to the fuel discharge to meet the changing demands of the engine. A small overall range of movement of the control unit results in a responsive and stable system which controls the liquid head of the fuel within the system and provides a very accurate air-fuel mixture.

The present invention also compensates for fluctuations in the air density, which cause the air-fuel ratio to drift. In one construction, ambient air flows through a booster venturi to the main venturi. A vacuum signal is taken from the booster venturi and is routed to the vacuum side of the air-sensing diaphragm of the liquid head control unit. An aneroid air sensor is utilized to sense the changes in the air density due to changes in the altitude or temperature. The aneroid is sized and charged with a dry inert gas which will expand and contract according to the air density. The expansion and contraction of the aneroid is used to control the depth of a straight venturi pin within the booster venturi. The straight venturi pin restricts the flow of ambient air moving through the booster venturi bore. The deeper the pin is extended into the booster venturi, the stronger the vacuum signal to the vacuum chamber side of the air-sensing diaphragm. A stronger vacuum signal to the vacuum chamber side of the air-sensing diaphragm causes a movement away from the free air valve which results in an increased pressure across the fuel orifice and also a throttling of the fuel inlet ball valve to allow more fuel to feed the system.

The heavier the air density, the more the aneroid will contract and move the venturi pin deeper into the booster venturi. An air density heavier than the base density results in a lean mixture which means there is not enough fuel flowing to the engine. As the density becomes lighter, the aneroid will expand and withdraw the pin from the booster, thereby reducing the vacuum to the vacuum side of the air-sensing diaphragm. A reduction in vacuum to the vacuum side of the air-sensing diaphragm moves the control unit towards the free air orifice and ultimately results in a reduction of fuel flow to match the changing air density. In this manner the aneroid air sensor can compensate for changing air densities which create a drift in the air-fuel ratio.

In another construction, ambient air flows through a straight booster sleeve to the main air venturi. The expansion and contraction of the aneroid chamber is used to control the depth of a tapered venturi pin within the booster sleeve. The booster sleeve contains three equally spaced ports which communicate a vacuum signal to the air sensing diaphragm of the liquid head control unit. As the aneroid expands due to a decrease in the air density, the depth of the tapered venturi pin within the booster sleeve increases, thereby reducing the vacuum signal across the three ports which act upon the vacuum chamber side of the air sensing diaphragm, causing a movement towards the free air orifice. This movement reduces the pressure across the fuel orifice and also reduces the flow of air to the regulator air chamber which results in a decreased fuel flow in order to compensate for the decreased air density. Should the air density increase, the aneroid contracts and withdrawals the tapered venturi pin within the booster sleeve a short distance which increases the vacuum signal across the three ports, which ultimately results in an increased fuel flow to compensate for the increased air density.

One embodiment of the invention includes a transfer member, means for sensing the fuel flow rate, means for sensing the air flow rate, means for generating a control unit signal, and means for controlling the fuel rate. The transfer member includes a first end and a second end at opposing positions. The means for sensing the fuel flow rate applies a force to the first end of the transfer member in relation to the fuel flow rate. The means for sensing the air flow rate applies a force to the second end of the transfer member in relation to the air flow rate. The means for generating a control unit signal generates a signal based on the position of the transfer member, the means for sensing the fuel flow rate, and the means for sensing the air flow rate. The means for controlling the fuel flow rate controls the rate of fuel flowing through the charge-forming fuel system based on the control unit signal from the means for generating a control unit signal, such that the ratio of the air flow rate to the fuel flow rate remains substantially constant.

In another embodiment, the present invention includes a body having a passage for the air to pass through. The means for sensing the fuel flow rate includes a fuel sensing diaphragm separating a primary fuel chamber and a secondary fuel chamber, the primary fuel chamber receiving the fuel flow of the charge-forming fuel system and the second fuel chamber receiving the fuel flow from the primary fuel chamber through a fuel flow restriction. The means for sensing the air flow rate includes an air sensing diaphragm separating a vacuum chamber from a free air chamber, the vacuum chamber being connected to the passage in the body and the free air chamber being open to substantially ambient air. The fuel sensing diaphragm applies the force of the means for sensing the fuel flow rate to the first end of the transfer member, and the air sensing diaphragm applies the force of the means for sensing the air flow rate to the second end of the transfer member. In a further embodiment, the means for generating the control unit signal is a control air chamber in fluid communication with the passage in the main body and in fluid communication with a control orifice in the free air chamber of the means for sensing the air flow rate; the air sensing diaphragm regulating the amount of air entering the control chamber based on the position of the air sensing diaphragm relative to the control orifice, and the means for controlling the fuel flow rate regulating the fuel flow rate based on the pressure in the control chamber. In yet a further embodiment, the means for controlling the fuel flow rate includes a valve, a regulator air chamber, and a regulator diaphragm and valve actuator. The valve regulates the fuel flow rate through the charge-forming fuel system. The regulator air chamber is in fluid communication with the control chamber. The regulator diaphragm and valve actuator separate the regulator fuel chamber and the regulator air chamber, and actuates the valve based on the pressure in the regulator fuel chamber and the pressure in the regulator air chamber. In yet even a further embodiment, a regulator spring applies a force to the regulator diaphragm valve actuator, and the regulator diaphragm and valve actuator actuate the valve based on the pressure in the regulator air chamber, and the force applied to the regulator diaphragm and valve actuator by the regulator spring.

In another embodiment, the present invention includes a body having a passage for the air to pass through, and a booster passage having a first end open to substantially ambient air, a second end in fluid communication with the passage of the body, and a vacuum signal port between the first end and the second end of the booster passage. The means for sensing the air flow rate includes an air sensing diaphragm separating a vacuum chamber from a free air chamber, the vacuum chamber being in fluid communication with the vacuum signal port in the booster passage, the free air chamber being in fluid communication with substantially ambient air, and the air sensing diaphragm applying the force of the means for sensing the air flow rate to the second end of the transfer member. In a further embodiment, the booster passage is a venturi shape, and a pin extends into the booster passage which is mounted to an aneroid chamber that is mounted to the body. As the density of the air passing through the booster passage increases, the extension of the pin into the booster passage increases. As the density of the air passing through the booster passage decreases, the extension of the pin into the booster passage decreases.

In another embodiment, the booster passage is a straight bore, and a tapered venturi pin extends into the booster passage. The tapered venturi pin is attached to an aneroid chamber which is positioned against an aneroid bonnet by the action of a retaining spring. As the density of the air passing through the booster passage increases, the extension of the tapered venturi pin into the booster passage decreases, thereby increasing the vacuum signal to the vacuum side of the air sensing diaphragm. As the air density decreases, the extension of the tapered venturi pin into the booster passage increases, thereby decreasing the vacuum signal to the vacuum side of the air sensing diaphragm.

In another embodiment, the present invention includes a body with a passage for the air to pass through, a discharge port in fluid communication with the passage, a free air port in fluid communication with the discharge port and in fluid communication with substantially free air, an air orifice disposed within the free air port, and a fuel discharge port in fluid communication with the free air port and being located between the air orifice and the discharge port. The fuel flowing through the charge-forming fuel system passes through the fuel discharge port and mixes with the air flowing through the air orifice in the free air port before being discharged through the discharge port in the passage of the body.

In another embodiment, the present invention further includes a body having a passage for the air which is to be combined with the fuel, a fuel shut off valve, and a means for opening the fuel shut off valve. The fuel shut off valve prevents the flow of fuel through the present invention in a normal condition. The means for opening the fuel shut off valve opens the fuel shut off valve upon sensing a pressure drop in a passage of the body. In a further embodiment, the means for opening the fuel shut off valve includes a fuel shut off diaphragm separating a diaphragm chamber and an ambient air chamber. The diaphragm air chamber is in fluid communication with the air passage in the body, and the ambient air chamber in fluid communication with substantially ambient air. A pressure drop inside the passage of the body causes the fuel shut off diaphragm to open the fuel shut off valve.

In another embodiment, the present invention includes a body having a passage for the air to pass and the means for sensing the fuel flow includes a fuel sensing diaphragm separating a primary fuel chamber from a secondary fuel chamber. The primary fuel chamber receives the fuel flow of the charge forming fuel system, the secondary fuel chamber is in fluid communication with the passage in the body, and the primary fuel chamber is in fluid communication with the secondary fuel chamber through an aperture in the fuel sensing diaphragm. The fuel sensing diaphragm applies the force of the means for sensing the fuel flow rate to the first end of the transfer member.

DETAILED DESCRIPTION

Figure 1:
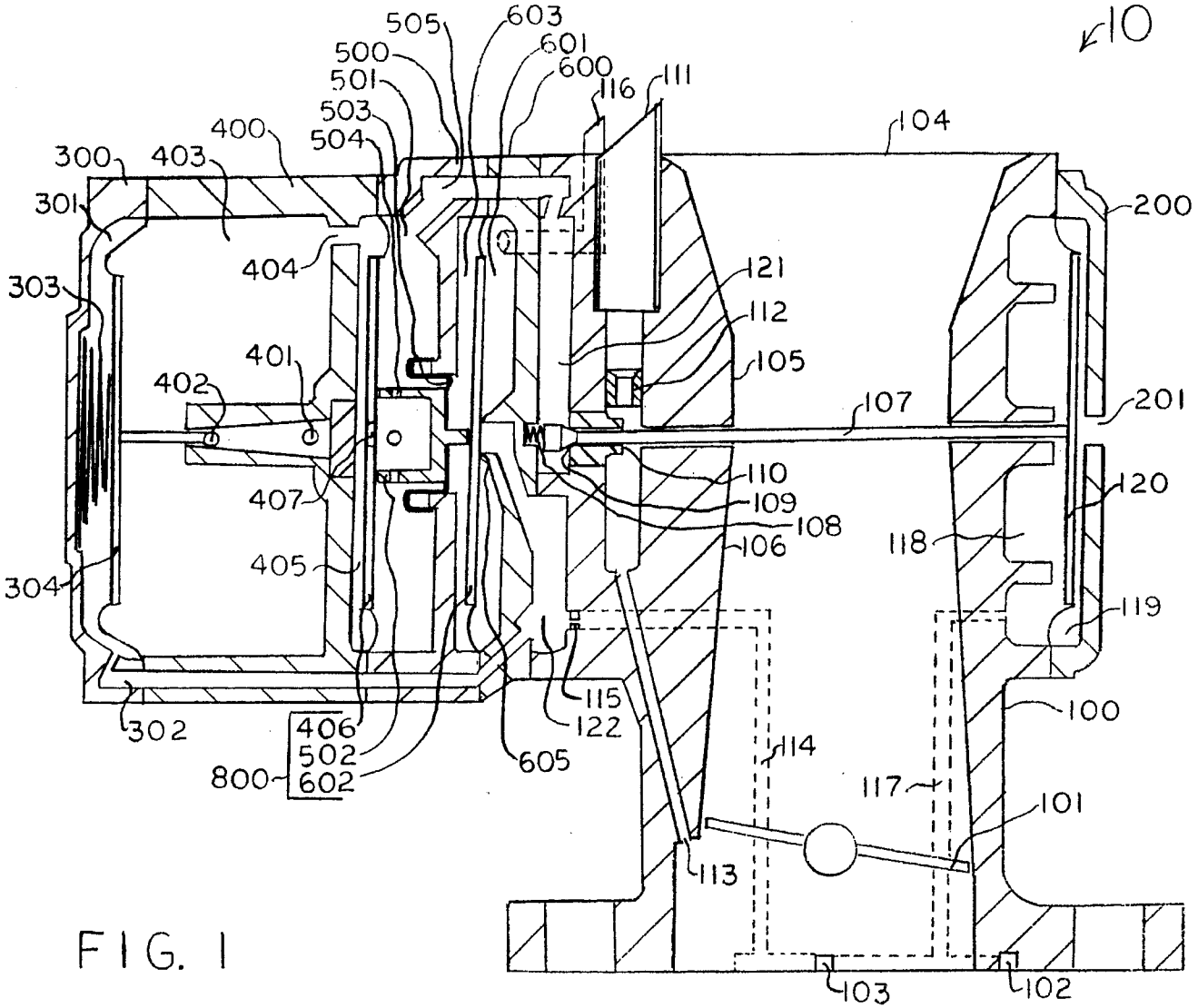
FIG. 1 is a plan cross-sectional view of an embodiment of the present invention, illustrated generally as a charge forming fuel system.

Referring now to FIG. 1, there is shown a plan cross-sectional view of an embodiment of the present invention, illustrated generally at 10 as a charge forming fuel system. The charge forming fuel system 10 has a main body 100 with an air passage or venturi bore 105 extending therethrough. Air enters an air inlet 104 of the venturi bore 105, and exits through a recovery skirt 106 of the venturi bore 105. A throttle plate 101 is disposed in a lower portion of the venturi bore 105 and controls the air flow rate through the venturi 105. A discharge port 113 is located below the throttle plate 101. A semicircular manifold vacuum passage 102 is formed by a groove cut into the bottom end of the main body 100. Manifold vacuum is provided to passage 102 across a vacuum port 103, which is also a groove at the bottom of main body 100.

Still referring to FIG. 1, a vacuum passage 117 in the main body 100 connects a diaphragm chamber 118 with the semicircular vacuum passage 102. The diaphragm chamber 118 is separated from an ambient air chamber 119 by a fuel shut-off diaphragm 120. The fuel shut-off diaphragm 120 is held in place by diaphragm cover 200 which includes a vent hole 201 for the ambient air chamber 119. A fuel shut-off valve 107 is normally closed by the force of a spring 108, and seats against a valve seat 109 of a fuel discharge 110. However, during operation of the charge forming fuel system 10, manifold vacuum across the vacuum port 103 is transferred to the diaphragm chamber 118, which causes the ambient air chamber 119 to have a larger pressure than the diaphragm chamber 118. The pressure difference between the diaphragm chamber 118 and the ambient air chamber 119 causes the fuel shut-off diaphragm 120 to open the fuel shut-off valve 107, which allows fuel to flow through the fuel discharge 110 during operation of the charge forming fuel system 10. In one construction, the shut-off valve 107 is opened by a vacuum of 0.1" to 0.3" of $H_2O$.

Referring still to FIG. 1, during operation of the charge forming fuel system 10, ambient air enters a free air passage 111 and crosses an air orifice 112, which accelerates the air before it meets fuel discharged from the fuel discharge 110. By discharging fuel from the fuel discharge 110 into the highly accelerated air stream from the air orifice 112, blending of the fuel and air is improved throughout all operational modes of the charge forming fuel system 10, thereby improving the efficiency of the engine and the ability of the engine to cleanly burn the fuel at all modes of operation of the charge forming fuel system 10. The discharged fuel enters the main air stream across the discharge port 113 located below the throttle plate 101.

Still referring to FIG. 1, fuel enters the charge forming fuel system 10 through a fuel inlet 401 of a fuel inlet body 400. After entering the fuel inlet body 400, fuel passes a fuel inlet ball valve 402 and into a regulator fuel chamber 403. The fuel flow rate through the charge forming fuel system 10 is controlled by a regulator diaphragm and plunger assembly 304 actuating the fuel inlet ball valve 402, as will be describe below. From the regulator fuel chamber 403, fuel passes through a fuel passage 404 into a primary fuel chamber 405. A fuel sensing diaphragm 406 separates the primary fuel chamber 405 from a secondary fuel chamber 501 in the transfer body 500. Fuel in the primary fuel chamber 405 passes into the secondary fuel chamber 501 through a fuel orifice 407 in the fuel sensing diaphragm 406, and through cross-holes 504 in a transfer member 502. A transfer member seal 503 prevents fuel in the secondary fuel chamber 501 from escaping pass the transfer member 502. From the secondary fuel chamber 501, fuel passes through a fuel passage 505 into a passage 121. Fuel in the passage 121 is then discharged through the fuel discharge 110, as described above, when the fuel shut-off valve 107 is in an open position.

Referring still to FIG. 1, it can be seen that fuel flowing through the charge forming fuel system 10 will cause a larger pressure in the primary fuel chamber 405 than the secondary fuel chamber 501. The difference between the pressure in the primary fuel chamber 405 and the pressure the secondary fuel chamber 501 is due to the fuel flow restriction caused by the fuel orifice 407 in the fuel sensing diaphragm 406. The larger pressure in the primary fuel chamber 405 will cause a force on the fuel sensing diaphragm 406 towards the secondary fuel chamber 501. It can also be seen that the greater the flow rate through the charge forming fuel system 10, the greater the pressure difference that the fuel orifice 407 will cause between the primary fuel chamber 405 and the secondary fuel chamber 501. Therefore, the greater the fuel flow rate through the charge forming fuel system 10, the greater the force will be on the fuel sensing diaphragm 406 towards the secondary fuel chamber 501. The force on the fuel sensing diaphragm 406 is received by the transfer member 502.

Still referring to FIG. 1, a free air body 600 of the charge forming fuel system 10, forms a free air chamber 601. The free air chamber 601 receives free air through a control air passage 116. An air sensing diaphragm 602 separates the free air chamber 601 from a vacuum chamber 603 in a transfer body 500. The transfer member 502 and the transfer member seal 503 also separate the vacuum chamber 603 from the secondary fuel chamber 501. The vacuum chamber 603 receives vacuum from the venturi bore 105 through a passage 604 (shown in FIG. 3).

Referring still to FIG. 1, the vacuum transferred to the vacuum chamber 603 from the venturi 105 by the passage 604 (shown in FIG. 3), causes the pressure in the vacuum chamber 603 to be smaller than the pressure in the free air chamber 601. The larger pressure in the free air chamber 601 will cause a force on the air sensing diaphragm 602 towards the vacuum chamber 603. Generally, as the air flow rate through the venturi 105 increases, the vacuum transferred from the venturi 105 to the vacuum chamber 603 will increase, which will increase the pressure difference between the free air chamber 601 and the vacuum chamber 603. As the difference in pressure between the free air chamber 601 and the vacuum chamber 603 increases, the force on the air sensing diaphragm 602 towards the vacuum chamber 603 will increase. Therefore, the greater the air flow rate through the venturi 105, the greater the force will be on the air sensing diaphragm 602 towards the vacuum chamber 603. The force on the air sensing diaphragm 602 is received by the transfer member 502.

Referring still to FIG. 1, the forces applied to the transfer member 502 by the fuel sensing diaphragm 406, due to the pressure difference between the primary fuel chamber 405 and the secondary fuel chamber 501, are opposing forces to the forces applied to the transfer member 502 by the air sensing diaphragm 602, due to the pressure difference between the vacuum chamber 603 and the free air chamber 601. In one embodiment, the fuel sensing diaphragm 406, the transfer member 502, and the air sensing diaphragm 602 are separate components; however, the fuel sensing diaphragm 406, the transfer member 502, and the air sensing diaphragm 602 move as a single unit or control unit 800 because of the opposing forces applied to the fuel sensing diaphragm 406 and the air sensing diaphragm 602. In another embodiment, the fuel sensing diaphragm 406, the transfer member 502, and the air sensing diaphragm 602 are components of a unitary control unit. An imbalance in the opposing forces applied to the fuel sensing diaphragm 406 and the air sensing diaphragm 602 will cause the control unit 800 to move. If the forces applied to the fuel sensing diaphragm 406 are greater than the forces applied to the air sensing diaphragm 602, the control unit 800 will move towards the free air chamber 601 and away from the primary fuel chamber 405. If the forces applied to the air sensing diaphragm 602 are greater than the forces applied to the fuel sensing diaphragm 406, the control unit 800 will move away from the free air chamber 601 and towards the primary fuel chamber 405.

Still referring to FIG. 1, a vacuum passage 114 connects the semicircular vacuum passage 102 with an air chamber 122. A vacuum orifice 115 in the vacuum passage 114 controls the rate at which vacuum from the vacuum port 103 is transferred to the air chamber 122. Air is supplied to the air chamber 122 through an air orifice 605 in the free air chamber 601. The rate that air is supplied to the air chamber 122 from the free air chamber 601 is controlled by the proximity of the air sensing diaphragm 602 to the air orifice 605. As the control unit 800 moves towards the free air chamber 601, the air sensing diaphragm 602 moves closer to the air orifice 605 and restricts the rate at which air from the free air chamber 601 passes through the air orifice 605 into the air chamber 122. As the control unit 800 moves away from the free air chamber 601, the air sensing diaphragm 601 moves away from the air orifice 605, which allows air from the free air chamber 601 to pass through the air orifice 605 and into the air chamber 122 at a greater rate.

Referring still to FIG. 1, the diaphragm and plunger assembly 304 and a fuel regulator bonnet 300 form a regulator air chamber 301. A regulator spring 303 provides a force upon the regulator diaphragm and plunger assembly 304 in a direction towards opening the fuel inlet ball valve 402 of the fuel inlet body 400. The regulator air chamber 301 communicates with the air chamber 122 through an air passage 302. As the pressure in the air chamber 122 decreases, the pressure in the regulator air chamber 301 decreases and the pressure in the regulator fuel chamber 403 forces the diaphragm and plunger assembly 304 away from the fuel inlet ball valve 402, which closes the fuel inlet ball valve 402 and reduces the flow rate of fuel through the charge forming fuels system 10. As the pressure in the air chamber 122 increases, the pressure in the regulator air chamber 301 increases and the regulator spring 303 and the pressure in the regulator air chamber 301 force the diaphragm and plunger assembly 304 towards the fuel inlet ball valve 402, which opens the fuel inlet ball valve 402 and increases the flow rate of fuel through the charge forming fuel system 10. In this manner, the diaphragm and plunger assembly 304 actuates the fuel inlet ball valve 402 to control regulate the fuel pressure in the regulator fuel chamber 403 and the fuel flow rate through the charge forming fuel system 10.

Figure 2:
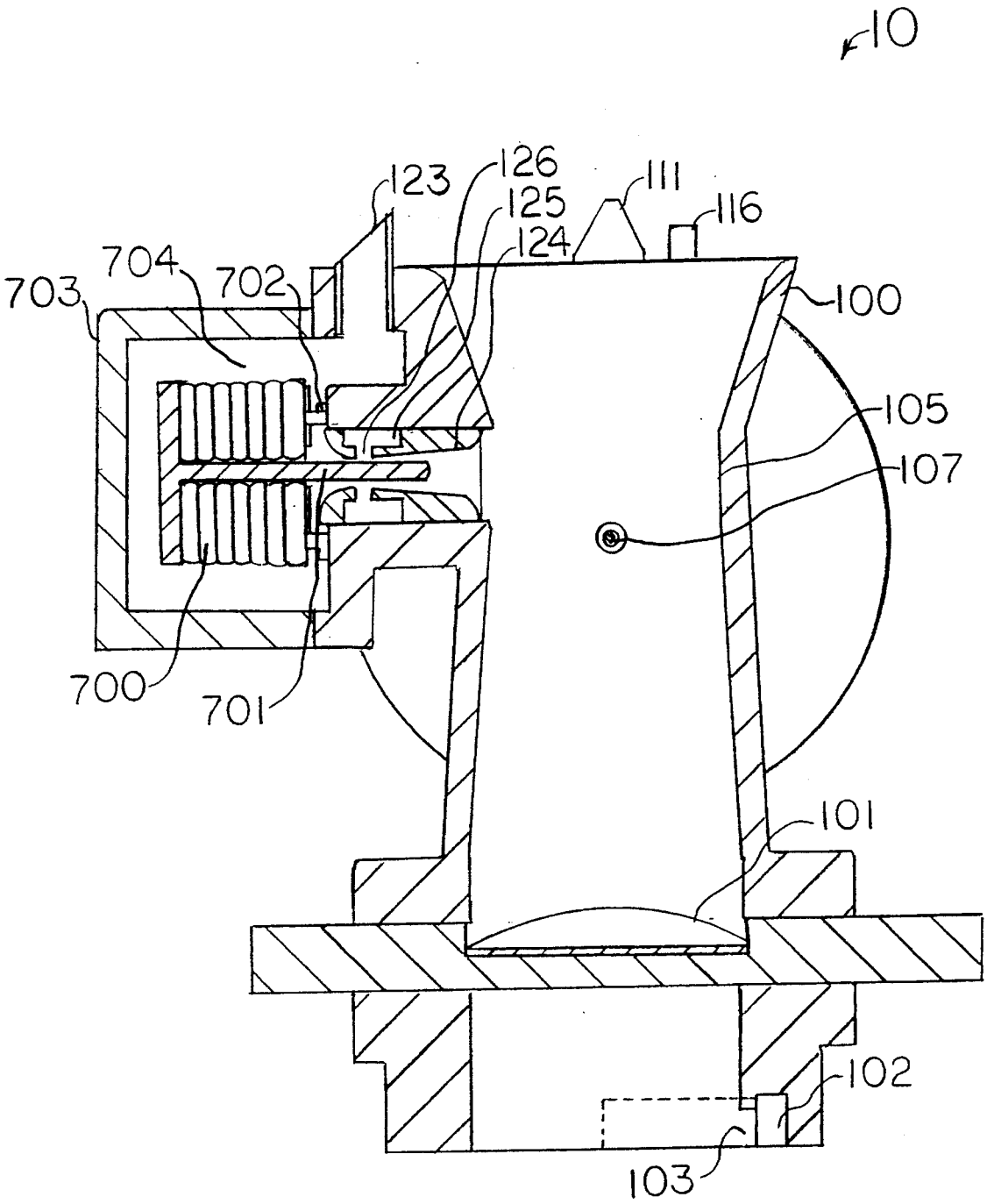
FIG. 2 is a plan cross-sectional view or the charge forming fuel system from FIG. 1, taken at 90° about the longitudinal axis of the venturi in the charge forming fuel system of FIG. 1.

Referring now to FIG. 2, there is shown a plan cross-sectional view of the charge forming system 10 from FIG. 1, taken at 90° about the longitudinal axis of the venturi 105. An aneroid bonnet 703 forms a free air chamber 704 with the main body 100. A free air tube 123 in the main body 100 allows air to enter the free air chamber 704. A booster venturi 124 is in communication between the free air chamber 704 and the venturi bore 105. An aneroid chamber or aneroid air sensor 700 is mounted in the free air chamber 704 by three mounting legs 702 which attach to the main body 100. A straight venturi pin 701 is attach to the aneroid air sensor 700 and extends into the main bore of the booster venturi 124. As the density of air increases, the aneroid sensor 700 will extend the venturi pin 701 further into the booster venturi 124. As the density of air decreases, the aneroid sensor 700 will reduce the extension of the venturi pin 701 into the booster venturi 124. A chamber 125 is in fluid communication with the booster venturi 124 through booster venturi orifices 126. The vacuum signal of the booster venturi 124 is communicated by the chamber 125 and the passage 604 (shown in FIG. 3) to the vacuum chamber 603 (shown in FIG. 1).

Figure 3:
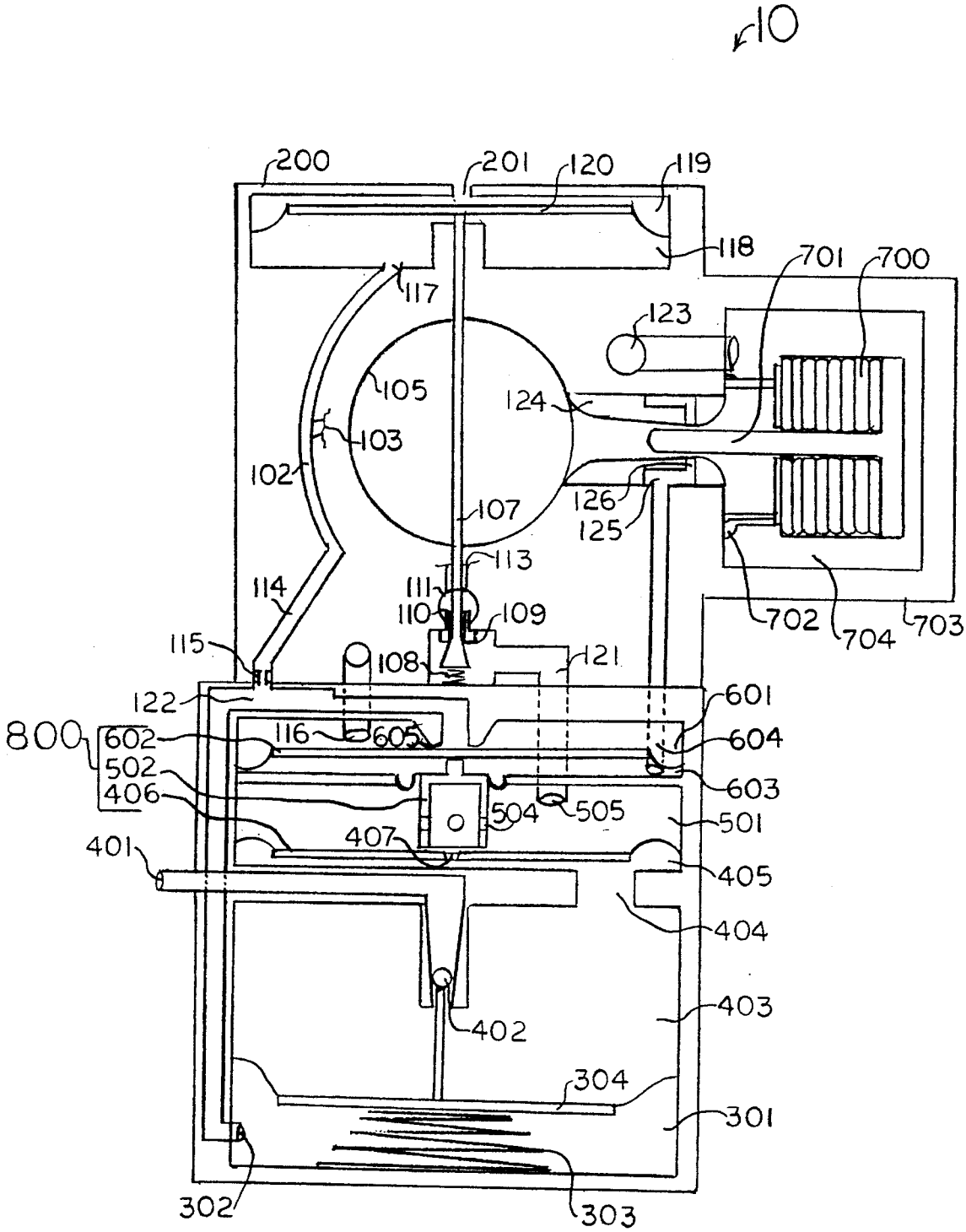
FIG. 3 is a schematic top view of the charge forming fuel system form FIG. 1.

Referring now to FIG. 3, there is shown a top schematic view of the charge forming fuel system 10 from FIG. 1. As previously described, the booster venturi 124 is in fluid communication between the venturi bore 105 and the free air chamber 704. The vacuum signal is communicated from the booster venturi 124 to the vacuum chamber 603 through the chamber 125 and the passage 604. Free air is communicated to the free air chamber 601 by the control air passage 116.

Still referring to FIG. 3, fuel enters the charge forming fuel system 10 through the fuel inlet 401 and passes the fuel inlet ball valve 402 into the regulator fuel chamber 403. The fuel passage 404 allows fuel in the regulator fuel chamber 403 to pass into the primary fuel chamber 405. Fuel in the primary fuel chamber 405 flows through the fuel orifice 407 in the fuel sensing diaphragm 406, and the cross-holes 504 in the transfer member 502, into the secondary fuel chamber 501. The fuel passage 505 and the passage 121 transmit fuel from the secondary fuel chamber 501 to the fuel discharge 110.

Referring still to FIG. 3, the semi-circular vacuum passage 102 is connected to a vacuum port 103. The air chamber 122 is connected to the semi-circular vacuum passage 102 by a vacuum passage 114 which has a vacuum orifice 115. The air chamber 122 is also in communication with the free air chamber 601 by an orifice 605. As the air sensing diaphragm 602 moves away from the orifice 605, the restriction of air entering the air chamber 122 through the orifice 605 is reduced. As the air sensing diaphragm 602 moves towards the orifice 605, the restriction of air entering the air chamber 122 through the orifice 605 is increased. In this manner, the control unit 800 will control the air pressure in the air passage 122. The air passage 302 connects the air chamber 122 with the regulator air chamber 301.

Still referring to FIG. 3, as the pressure in the air chamber 122 increases, the pressure in the regulator air chamber 301, and against the regulator diaphragm and plunger assembly 304, increases. As the pressure in the air chamber 122 decreases, the pressure in the regulator air chamber 301 and against the regulator diaphragm and plunger assembly 304 decreases. In this manner, movement of the control unit 800 will control the pressure against the regulator diaphragm and plunger assembly 304, and consequently the opening and closing of the ball valve 402.

Referring now to FIGS. 1, 2, 3, and 4 in combination, the operation of the charge forming fuel system 10 can be explained. The fuel inlet ball valve 402 is normally open due to the force of the regulator spring 303 acting upon the regulator diaphragm and plunger assembly 304. Initially, fuel fills the system chambers 403, 405, 501, and 121. When the engine (not shown) is cranked, manifold vacuum acting through the vacuum port 103 creates a pressure difference across the fuel shut-off diaphragm 120 which opens the fuel shut-off valve 107 and allows fuel to exit through the fuel discharge 110 into the accelerated air stream created by the air orifice 112. In one embodiment, the vacuum required to open the fuel shut-off valve 107 is only 0.1" to 0.3" $H_2O$, which allows for an easy start and provides remote or automatic starting capabilities.

Still referring to FIGS. 1, 2, 3, and 4 in combination, once the engine starts, the air sensing diaphragm 602, the transfer member 502, and the fuel-sensing diaphragm 406 move together as the single control unit 800, as described above. A force, which represents the air flow rate through the main venturi 105, is applied to the transfer member 502 by the air sensing diaphragm 602 due to difference between the ambient air pressure in the free air chamber 601 and the venturi vacuum in the vacuum chamber 603. An opposing force, which represents the fuel flow rate through the charge forming fuel system 10, is applied to the transfer member 502 by the fuel sensing diaphragm 406 due to the difference between the fuel pressure in the primary fuel chamber 405 and the fuel pressure in the secondary fuel chamber 501. The opposing forces seek to balance one another for positioning the control unit 800 to a location which will assure the proper fuel delivery. A smaller range of movement of the control unit 800 results in a very responsive charge forming fuel system 10. In one embodiment, the range of movement for the control unit 800 is less than 0.010 inches.

Referring still to FIGS. 1, 2, 3, and 4 in combination, an increase in air movement through the main venturi 105, causes an imbalance of forces acting on the fuel sensing diaphragm 406 and the air sensing diaphragm 602, which causes the control unit 800 to move away from the free air orifice 605. This movement increases the pressure difference across the fuel orifice 407 which feeds more fuel to the fuel discharge 110. This same movement also allows a greater volume of free air to cross the free air valve 605 and act upon the regulator air chamber 301 via air passage 302, which causes the regulator diaphragm and plunger assembly 304 to further open the fuel inlet ball valve 402 allowing more fuel to enter the charge forming fuel system 10 to meet the increased demand. The free air acting upon the regulator diaphragm and plunger assembly 304 is bled down by manifold vacuum across the vacuum orifice 115.

Still referring to FIGS. 1, 2, 3, and 4 in combination, a decrease in air movement through the main venturi 105 signals a demand for less fuel, and creates an imbalance of forces which cause the control unit 800 to move towards the free air orifice 605. This movement reduces the pressure difference across the fuel orifice 407 which feeds the fuel discharge 110. This same movement also decreases the volume of air across the free air orifice 605, which reduces the volume of air acting upon the regulator diaphragm and plunger assembly 304. A reduction of the volume of air acting on the regulator diaphragm and plunger assembly 304 results in a closing action of the fuel inlet ball valve 402 to reduce the flow of fuel to meet the decreased demand.

Referring still to FIGS. 1, 2, 3, and 4 in combination, the force which moves the fuel is the pressure difference between the regulator fuel chamber 403 and the fuel discharge 110. This pressure difference can be the result of the force of the regulator spring 303, or from the difference between the inlet pressure of the fuel and the vacuum at the fuel discharge 110, or a combination of the two.

Still referring to FIGS. 1, 2, 3, and 4 in combination, the liquid head control of the charge forming fuel system 10 can compensate for variations in the inlet pressure of the fuel. Should there be a slight surge in the inlet pressure, the fuel pressure will increase in the primary fuel chamber 405 and in the regulator fuel chamber 403. An increased fuel pressure in the primary fuel chamber 405 will cause the control unit 800 to move towards the free air orifice 605, which reduces the volume of air passing into the air chamber 122 and decreases the air pressure in the regulator air chamber 301. A decreased air pressure in the regulator air chamber 301 reduces the forces applied to the regulator diaphragm and plunger assembly 304, which oppose the forces applied by the fuel pressure in the regulator fuel chamber 403, and tends to close the fuel inlet ball valve 402. An increased fuel pressure in the regulator fuel chamber will apply additional forces to the regulator diaphragm and plunger assembly 304, which tends to close the fuel inlet ball valve 402. An extreme surge of inlet fuel pressure will cause the regulator diaphragm and plunger assembly 304 to seat the fuel inlet ball valve 402 and stop the fuel flow through the charge forming fuel system 10. A short fall of fuel inlet pressure will decrease the fuel pressure in the primary fuel chamber 405 and in the regulator fuel chamber 403. A decreased fuel pressure in the primary fuel chamber 405 will cause the control unit 800 to move away from the free air orifice 605, which increases the volume of air passing into the air chamber 122 and increase the air pressure in the regulator air chamber 301. An increased air pressure in the regulator air chamber 301 increases the forces applied to the regulator diaphragm and plunger assembly 304, which oppose the forces applied by the pressure in the regulator fuel chamber 403, and tends to move the regulator diaphragm and plunger assembly 304 to open the fuel inlet ball valve 402. A decreased pressure in the regulator fuel chamber will reduce the forces applied to the regulator diaphragm and plunger assembly 304 which oppose the forces applied by the regulator air chamber 301 and the regulator spring 303, and tends to open the fuel inlet ball valve 402.

Referring now to FIGS. 1, 2, and 3 in combination, air is fed by the free air tube 123 across the aneroid air sensor 700, via chamber 704. The aneroid air sensor 700 senses any change in the air density. The heavier the air density, the further the aneroid air sensor 700 will extend the venturi pin 701 into the booster venturi 124, thereby increasing the velocity of the air flowing through the booster venturi 124. The higher the velocity of the air moving through the booster venturi 124, the stronger the vacuum signal will be across the booster venturi orifices 126 and in the chamber 125. A stronger vacuum signal in the chamber 125 will increase the vacuum in the vacuum chamber 603 which acts on the air sensing diaphragm 602, causing the control unit 800 to move further away from the free air orifice 605. Movement of the control unit 800 away from the free air orifice 605 increases the pressure difference across the fuel orifice 407 and increases the volume of air acting upon the fuel regulator diaphragm and plunger assembly 304, which further opens the fuel inlet ball valve 402 to allow more fuel flow through the charge forming fuel system 10 to compensate for the heavier air density.

Still referring to FIGS. 1, 2, and 3 in combination, should the air density become lighter, the aneroid air sensor 700 expands, thereby partially withdrawing the venturi pin 701 from the booster venturi 124, which reduces the velocity of the air moving through the booster venturi 124. The lower the velocity of the air moving through the booster venturi 124, the lower the vacuum signal will be across the booster venturi orifices 126 and in the chamber 125. A reduced vacuum signal in the chamber 125 will decrease the vacuum in the vacuum chamber 603 which acts on the air sensing diaphragm 602, causing the control unit 800 to move towards the free air orifice 605. Movement of the control unit 800 away from the free air orifice 605 reduces the pressure difference across the fuel orifice 407 and reduces the volume of air acting upon the fuel regulator diaphragm and plunger assembly 304, which further closes the fuel inlet ball valve 402 to reduce the fuel flow through the charge forming fuel system 10 to compensate for the lighter air density.

Figure 4:
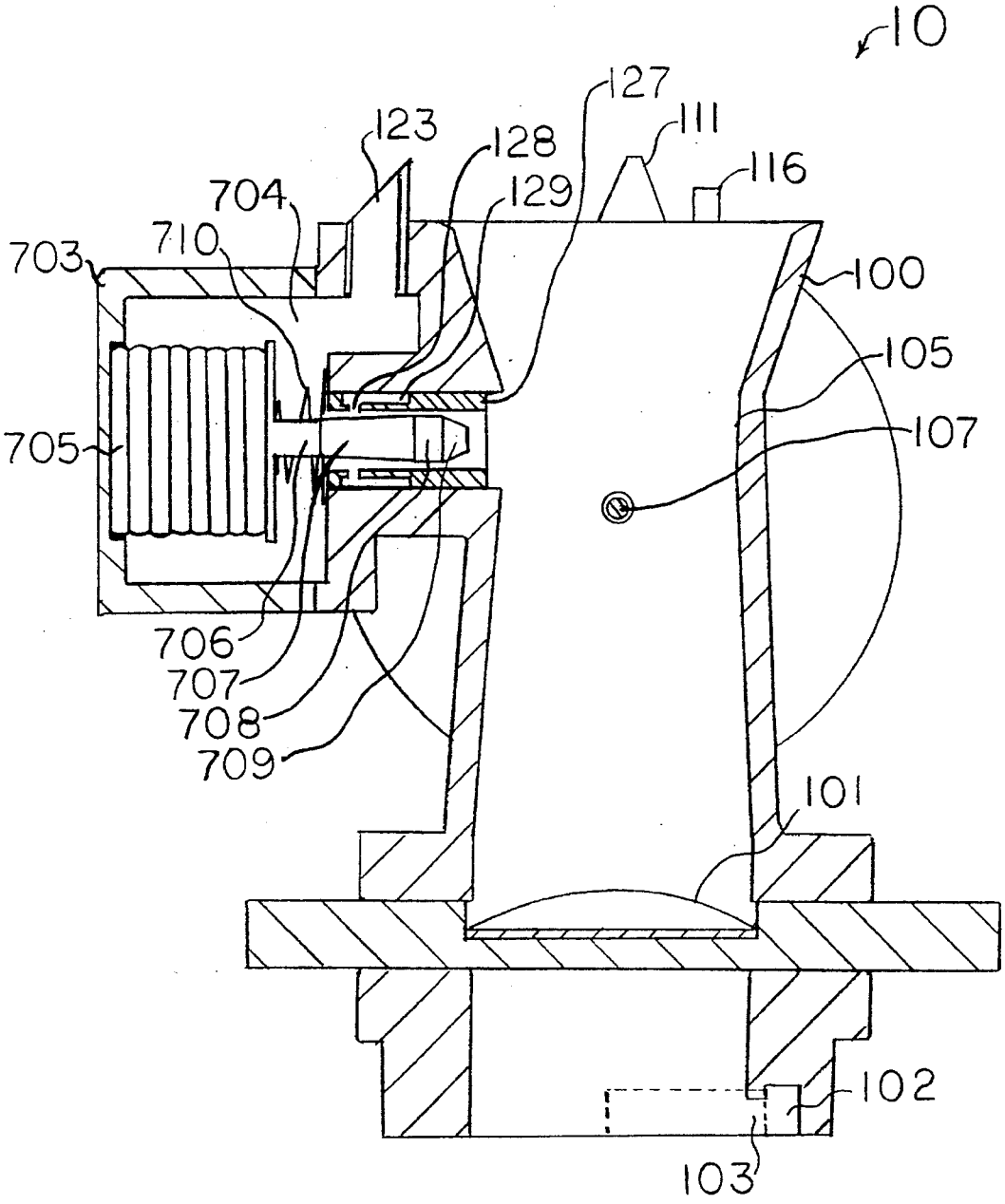
FIG. 4 illustrates another embodiment of the air density aneroid sensor of FIG. 2.

Referring now to FIG. 4, there is illustrated a further embodiment of the charge forming system 10 of FIG. 2. An aneroid bonnet 703 forms a free air chamber 704 with the main body 100. Free air enters a free air tube 123 in the main body 100 and enters the free air chamber 704. A straight booster sleeve 127 is in communication between the free air chamber 704 and the main venturi bore 105. An aneroid chamber or aneroid air sensor 705 and its tapered venturi pin 706 are positioned against the aneroid bonnet 703 by a retaining spring 710, the action of which also serves to counteract the pressure difference between the free air chamber 704 and the venturi vacuum generated across the main air venturi 105 which tends to force the venturi pin 706 towards the venturi 105. The tapered venturi pin 706 has a first tapered section 707 which gradually increases in diameter until it meets a straight section 708, and a second tapered section 709, which gradually decreases in diameter. The straight booster sleeve 127 contains three equally spaced orifices 128 which communicate the vacuum signal generated by the air movement through the booster sleeve 127 to a chamber 129. The chamber 129 communicates the vacuum signal to the vacuum chamber 603 (shown in FIG. 1). As the aneroid sensor 705 expands due to a decrease in air density, the tapered venturi pin 706 extends further into the booster sleeve 127. This movement decreases the vacuum signal across the three orifices 128 which communicate with the vacuum chamber 603 of the control unit 800 (shown in FIG. 1). The decreased vacuum to the vacuum chamber 603 ultimately results in a reduction of fuel flow to compensate for the decreased air density. Should the air density increase, the aneroid sensor 705 will contract and lessen the extension of the tapered venturi pin 706 within the booster sleeve 127, thereby increasing the vacuum signal across the three orifices 128, which ultimately results in an increased flow of fuel to compensate for the increased air density.

Referring back now to FIGS. 1, 2, 3, and 4 in combination, the controlled liquid head of fuel to the fuel discharge 110 provides for an accurate fuel delivery based upon the demands on the charge forming fuel system 10. The action of the aneroid air sensor 700 of FIGS. 2 and 3, and the aneroid air sensor 705 of FIG. 4, provide a means to properly compensate for the drift in the air density by manipulating the control unit 800 in such a manner as to assure a proper and stable air-fuel ratio. The above described charge-forming device utilizes a fixed air-fuel ratio; however, other controls such as a vacuum sensitive part throttle control could be added to provide for fuel enrichment for the idle and max power modes for the larger engines or for motor vehicles.

Although the present invention has been described in considerable detail with reference to certain embodiments thereof, other embodiments are possible. For example, the fuel sensing diaphragm 406 and the air sensing diaphragm 602 could apply pulling forces on the transfer member 502 instead of pushing or compressing forces. Therefore, the spirit and scope of the appended claims should not be limited to the description of the embodiments contained herein.

I claim:

1. A charge forming fuel system for regulating the flow rate of fuel to be combined with air, said system comprising:

a transfer member, said transfer member having a first end and a second end at opposing positions;

means for sensing the fuel flow rate and applying a force to the first end of said transfer member in relation to the fuel flow rate;

means for sensing an air flow rate and applying a force to the second end of said transfer member in relation to the air flow rate;

means for generating a control unit signal based on the position of said means for sensing the fuel flow rate, said transfer member, and said means for sensing the air flow rate; and means for controlling the fuel flow rate based on the control unit signal from said means for generating a control unit signal, wherein the ratio of the air flow rate and the fuel flow rate remain substantially constant.

2. The charge forming fuel system according to claim 1, including a body having a passage for the air to be combined with the fuel to pass through, and wherein:

said means for sensing the fuel flow rate includes a fuel sensing diaphragm separating a primary fuel chamber and a secondary fuel chamber, the primary fuel chamber receiving the fuel flow of said charge forming fuel system, the secondary fuel chamber receiving the fuel flow from the primary fuel chamber through a fuel flow restriction, and the fuel sensing diaphragm applying the force of said means for sensing the fuel flow rate to the first end of said transfer member; and said means for sensing the air flow rate includes an air sensing diaphragm separating a vacuum chamber from a free air chamber, the vacuum chamber being connected to the passage in said body, the free air chamber being open to substantially ambient air, and the air sensing diaphragm applying the force of said means for sensing the air flow rate to the second end of said transfer member.

3. The charge forming fuel system according to claim 2, wherein said means for generating the control unit signal includes a control air chamber in fluid communication with the passage in said body and in fluid communication with a control orifice in the free air chamber of said means for sensing the air flow rate, wherein the air sensing diaphragm regulates the amount of air entering the control chamber based on the position of the air sensing diaphragm relative to the control orifice, and wherein the means for controlling the fuel flow rate regulates the fuel flow rate based on the pressure in the control chamber.

4. The charge forming fuel system according to claim 3, wherein said means for controlling the fuel flow rate includes:

a valve regulating the fuel flow rate through said charge forming fuel system;

a regulator fuel chamber receiving the fuel flow of said charge forming fuel system prior to the primary fuel chamber of said means for sensing the fuel flow rate;

a regulator air chamber in fluid communication with the control chamber; and a regulator diaphragm and valve actuator separating the regulator fuel chamber and the regulator air chamber, wherein said regulator diaphragm and valve actuator actuate said valve based on the pressure in the regulator fuel chamber and the pressure in the regulator air chamber.

5. The charge forming fuel system according to claim 4, including a regulator spring applying a force to said regulator diaphragm and valve actuator, wherein said regulator diaphragm and valve actuator actuate said valve based on the pressure in the regulator fuel chamber, the pressure in the regulator air chamber, and the force applied to said regulator diaphragm and valve actuator by said regulator spring.

6. The charge forming fuel system according to claim 1, further comprising a body having a passage for the air which is to be combined with the fuel, and wherein:

said body further includes a booster passage having a first end open to substantially ambient air, a second end in fluid communication with the passage of said body, and a vacuum signal port between the first end and the second end of the booster passage; and said means for sensing the air flow rate further includes an air sensing diaphragm separating a vacuum chamber from a free air chamber, the vacuum chamber being in fluid communication with the vacuum signal port in the booster passage in said body, the free air chamber being in fluid communication with substantially ambient air, and the air sensing diaphragm applying the force of said means for sensing the air flow rate to the second end of said transfer member.

7. The charge forming fuel system according to claim 6, wherein the booster passage in said body is a venturi shape, and further including:

an aneroid chamber mounted to said body; and a pin extending into the booster passage of said body and mounted to said aneroid chamber so that said aneroid chamber increases the extension of said pin into the booster passage as the density of the air passing through the booster passage increases and decreases the extension of said pin into the booster passage as the density of air passing through the booster passage decreases.

8. The charge forming fuel system according to claim 6, wherein the booster passage in said body is a straight bore, and further including:

an aneroid chamber having a first end and a second end, the first end being held stationary relative to said body;

a tapered pin having a first tapered section which expands to a substantially straight section and a second tapered section decreasing in size from the substantially straight section, said tapered pin being attached to the second end of said aneroid chamber with the first tapered section being closer to said aneroid chamber than the second tapered section; and wherein said tapered pin is positioned extending into the booster passage so that said aneroid chamber increases the extension of said tapered pin into the booster passage as the density of air passing through the booster passage decreases and decreases the extension of said pin into the booster passage as the density of air passing through the booster passage increases.

9. The charge forming fuel system according to claim 8, further including:

an aneroid bonnet attached to said body and covering said aneroid chamber; and a retaining spring positioned between said body and the second end of said aneroid chamber, wherein the force exerted by said retaining spring against the second end of said aneroid chamber forces the first end of said aneroid chamber against said aneroid bonnet such that the first end of the aneroid chamber is held stationary relative to said body.

10. The charge forming fuel system according to claim 1, further comprising a body including:

a passage for the air which is to be combined with the fuel;

a discharge port in fluid communication with the passage;

a free air port in fluid communication with the discharge port and in fluid communication with substantially ambient air;

an air orifice disposed within the free air port;

a fuel discharge port in fluid communication with the free air port and being located between the air orifice and the discharge port;

wherein said fuel flowing through said charge forming fuel system passes through the fuel discharge port and mixes with air flowing through the air orifice in the free air port before being discharged through the discharge port into the passage of said body.

11. The charge forming fuel system according to claim 1, further comprising a body having a passage for the air which is to be combined with the fuel, and further including:

a fuel shut off valve, wherein said fuel shut off valve prevents the flow of fuel through said charge forming fuel system in a normal condition; and means for opening said fuel shut off valve upon sensing a pressure drop in the passage of said body.

12. The charge forming fuel system according to claim 11, wherein said means for opening said fuel shut off valve includes a fuel shut off diaphragm separating a diaphragm chamber and an ambient air chamber, the diaphragm chamber being in fluid communication with the passage in said body and the ambient air chamber being in fluid communication with substantially ambient air, wherein a pressure drop inside the passage of said body causes the fuel shut off diaphragm to open said fuel shut off valve.

13. The charge forming fuel system according to claim 1, including a body having a passage for the air to combine with the fuel to pass through, and wherein said means for sensing the fuel flow rate includes a fuel sensing diaphragm separating a primary fuel chamber from a secondary fuel chamber, the primary fuel chamber receiving the fuel flow of said charge forming fuel system, the secondary fuel chamber being in fluid communication with the passage in said body, the primary fuel chamber being in fluid communication with the secondary fuel chamber through an aperture in the fuel sensing diaphragm, and the fuel sensing diaphragm applying the force of said means for sensing the fuel flow rate to the first end of said transfer member.

14. A charge forming fuel system for regulating the flow rate of fuel to be combined with air, said system comprising:

a body having a passage for said air used by said charge forming device for combining with said fuel;

a transfer member with a first end and a second end at opposing positions of said transfer member;

means for sensing the fuel flow rate and applying a force to the first end of Said transfer member in relation to the fuel flow rate;

means for sensing an air flow rate through said passage in said body and applying a force to the second end of said transfer member in relation to the air flow rate; and means for controlling the fuel flow rate through said charge forming fuel system based on the position of said transfer member, said means for sensing said fuel flow rate, and said means for sensing said air flow rate;

said body further includes a booster passage having a first end open to substantially ambient air, a second end in fluid communication with the passage of said body, and a vacuum signal port between the first and second end of the booster passage;

said means for sensing the air flow rate further includes an air sensing diaphragm separating a vacuum chamber from a free air chamber, the vacuum chamber being in fluid communication with the vacuum signal port in the booster passage in said body, the free air chamber being in fluid communication with substantially ambient air, and the air sensing diaphragm applying the force of said means for sensing the air flow rate to the second end of said transfer member;

wherein said booster passage in said body is a straight bore;

and further including:

an aneroid chamber having a first end and a second end, the first end being held stationary relative to said body;

a tapered pin having a first tapered section which expands to a substantially straight section and a second tapered section decreasing in size from the substantially straight section, said tapered pin being attached to the second end of said aneroid chamber with the first tapered section being closer to said aneroid chamber than the second tapered section; and wherein said tapered pin is positioned extending into the booster passage so that said aneroid chamber increases the extension of said tapered pin into the booster passage as the density of air passing through the booster passage decreases and decreases the extension of said pin into the booster passage as the density of air passing through the booster passage increases.

15. The charge forming fuel system according to claim 14, further including:

an aneroid bonnet attached to said body and covering said aneroid chamber; and a retaining spring positioned between said body and the second end of said aneroid chamber, wherein the force exerted by said retaining spring against the second end of said aneroid chamber forces the first end of said aneroid chamber against said aneroid bonnet such that the first end of the aneroid chamber is held stationary relative to said body.

16. A charge forming fuel system for regulating the flow rate of fuel to be combined with air, said system comprising:

a body having a passage for said air used by said charge forming device for combining with said fuel;

a transfer member with a first end and a second end at opposing positions of said transfer member;

means for sensing the fuel flow rate and applying a force to the first end of said transfer member in relation to the fuel flow rate;

means for sensing an air flow rate through said passage in said body and applying a force to the second end of said transfer member in relation to the air flow rate; and means for controlling the fuel flow rate through said charge forming fuel system based on the position of said transfer member, said means for sensing said fuel flow rate, and said means for sensing said air flow rate; and wherein said body includes:

a discharge port in fluid communication with the passage;

a free air port in fluid communication with the discharge port and in fluid communication with substantially ambient air;

an air orifice disposed within the free air port;

a fuel discharge port in fluid communication with the free air port and being located between the air orifice and the discharge port; and wherein said fuel flowing through said charge forming fuel system passes through the fuel discharge and mixes with air flowing through the air orifice in the free air port before being discharged through the discharge port into the passage of said body.

17. A charge forming fuel system for regulating the flow rate of fuel to be combined with air, said system comprising:

a body having a passage for said air used by said charge forming device for combining with said fuel;

a transfer member with a first end and a second end at opposing positions of said transfer member;

means for sensing the fuel flow rate and applying a force to the first end of said transfer member in relation to the fuel flow rate;

means for sensing an air flow rate through said passage in said body and applying a force to the second end of said transfer member in relation to the air flow rate; and means for controlling the fuel flow rate through said charge forming fuel system based on the position of said transfer member, said means for sensing said fuel flow rate, and said means for sensing said air flow rate; and wherein said means for sensing the fuel flow rate includes a fuel sensing diaphragm separating a primary fuel chamber from a secondary fuel chamber, the primary fuel chamber receiving the fuel flow of said charge forming fuel system, the secondary fuel chamber being in fluid communication with the passage in said body, the primary fuel chamber being in fluid communication with the secondary fuel chamber through an aperture in the fuel sensing diaphragm, and the fuel sensing diaphragm applying the force of said means for sensing the fuel flow rate to the first end of said transfer member.

* * * * *